United States Patent [19]

Baltensperger et al.

[11] 4,334,119

[45] Jun. 8, 1982

[54] CHANNEL FURNACE HAVING A MAGNETIC CORE FOR GENERATING THREE-DIMENSIONAL MAGNETIC FIELDS

[75] Inventors: Heinz Baltensperger, Mellingen; Karl Buhler, Nussbaumen; Werner Schott, Baden, all of Switzerland

[73] Assignee: BBC Brown, Boveri & Company, Ltd., Baden, Switzerland

[21] Appl. No.: 229,941

[22] Filed: Jan. 30, 1981

Related U.S. Application Data

[63] Continuation-in-part of Ser. No. 78,688, Sep. 25, 1979.

[51] Int. Cl.[3] ..... H05B 5/14

[52] U.S. Cl. ..... 373/159

[58] Field of Search ..... 13/29; 336/212, 234, 336/233

[56] References Cited

U.S. PATENT DOCUMENTS

| | | | |
|---|---|---|---|
| 1,394,901 | 10/1921 | Hobart | 336/212 X |
| 1,471,263 | 10/1923 | Hobart | 336/212 X |
| 4,021,602 | 5/1977 | Delassus | 13/29 |

*Primary Examiner*—Roy N. Envall, Jr.

*Attorney, Agent, or Firm*—Burns, Doane, Swecker & Mathis

[57] ABSTRACT

A channel furnace has a magnetic core, for use with a coil in generating a three-dimensional magnetic field, comprising a center core, formed by disk-shaped sheets stacked in cylindrical form, and an outside core surrounding the center core and formed by generally radial sheets having an involute shape. This form of construction of a magnetic core provides for the efficient generation of both axially and radially oriented magnetic fields.

2 Claims, 4 Drawing Figures

Fig. 1
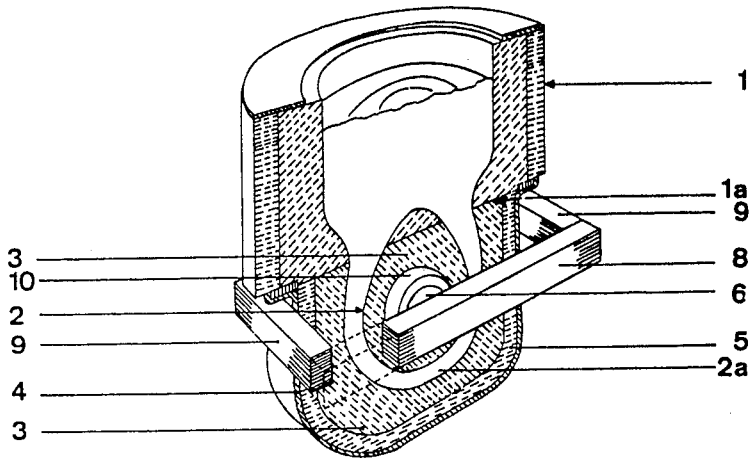
Fig. 2
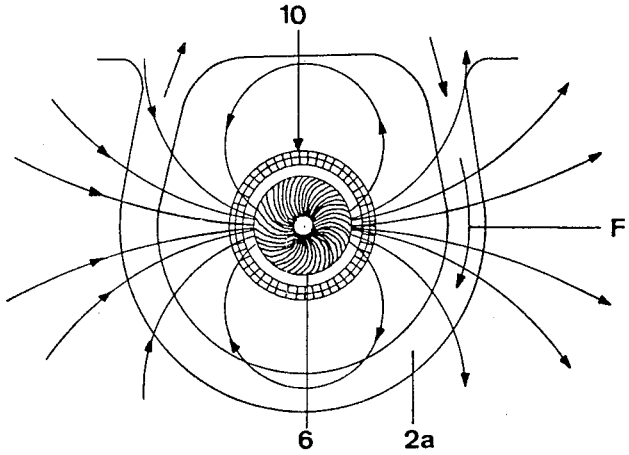
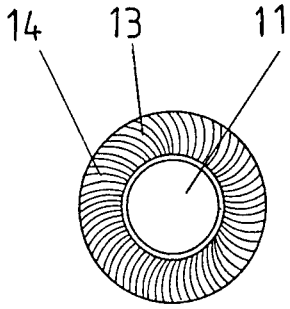
FIG.3a
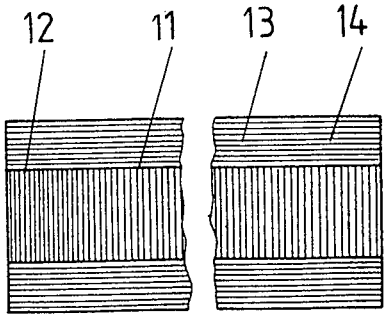
FIG.3b

CHANNEL FURNACE HAVING A MAGNETIC CORE FOR GENERATING THREE-DIMENSIONAL MAGNETIC FIELDS

CROSS-REFERENCE TO RELATED APPLICATION

This application is a continuation-in-part of copending application Ser. No. 78,688 filed Sept. 25, 1979.

BACKGROUND OF THE INVENTION

The present invention relates to a channel furnace for melting metals and alloys, and more particularly to a novel magnetic core for use in generating a three-dimensional magnetic field in such a furnace.

German Offenlegungsschrift No. 2,608,310 discloses a channel furnace having an inductor that generates both axially and radially oriented magnetic fields. The core of the inductor comprises a center core, which is designed as a solid round bolt having ends that are provided with threads for attachment of the core to support structure in the furnace, and an outside core, which is formed by substantially radial sheets, that are preferably in the shape of an involute. One disadvantage of this type of core lies in the fact that the solid bolt forming the center core characteristically is susceptible to high flux losses during the generation of alternating magnetic fields.

OBJECTS AND SUMMARY OF THE INVENTION

It is therefore an object of the present invention to provide a channel furnace with a novel magnetic core, for use with a coil in generating a three-dimensional magnetic field, which overcomes the above-mentioned disadvantage of prior art channel furnaces and which ensures good magnetic properties for producing both axially and radially oriented magnetic fields.

In the preferred embodiment of the present invention, a channel furnace has a magnetic core for use in generating three-dimensional magnetic fields that comprises a center core and an outside core surrounding the center core. The center core consists of disk-shaped sheets lying in parallel planes extending in the transverse direction of the core and stacked upon one another to produce a substantially cylindrical core. The outer core consists of generally radially oriented sheets lying in planes extending in the longitudinal direction of the core. These sheets preferably have an involute shape, i.e., the sheets have a predefined curve in the circumferential direction, rather than being perfectly linear in the radial direction.

An advantage of this form of the invention is that only a small amount of radially oriented magnetic flux is delivered to the center core by the outside core, thereby producing only slight flux losses in the radial portion of the field being conducted by the inner core. The center core does not conduct any axially directed flux in this embodiment of the invention, and thereby does not interfere with the axially directed flux conducted by the outer core.

BRIEF DESCRIPTION OF THE DRAWINGS

The objectives and advantages of the present invention will be better appreciated upon a perusal of the following detailed description of the preferred embodiments of the invention in conjunction with the accompanying drawings, in which:

FIG. 1 is a partly sectional view of a channel furnace embodying the present invention;

FIG. 2 is a partial sectional view of the lower portion of a channel furnace, illustrating the configuration of the rotating magnetic field for producing circulation of the molten metal in the channel of the furnace;

FIG. 3*a* is an axial view of a magnetic core comprising a center core of disk-shaped sheets and an outside core of radial sheets in involute form; and FIG. 3*b* is a longitudinal cross-section through the magnetic core illustrated in FIG. 3*a*.

DETAILED DESCRIPTION

A channel furnace constructed according to the present invention, illustrated in FIG. 1, includes a melting tank 1 having walls made of a refractory material, and presents a substantially horizontal flat bottom 1*a* below the tank 1. A duct 2 with refractory walls forms a loop in a substantially vertical plane. The ends of the inner channel 2*a* of the duct open into different zones of the bottom 1*a* of the tank, for example into diametrically opposite zones of the bottom 1*a* if the tank 1 is cylindrical. The refractory walls of the duct 2 are formed, for example, by an assembly 3 of rings of concrete, the rigidity of the assembly being assured by an outer metal casing 4 internally lined with refractory bricks 5.

A magnetic core 6 passes across the central orifice of the loop formed by the duct 2. The magnetic core 6 is completed by two yokes 8, of a laminated magnetic material and perpendicular to core 6, and by two columns 9, also of a laminated magnetic material, so as thereby to form a closed magnetic circuit. An inductor winding 10 is wound around the magnetic core.

The conductors forming the winding 10 are preferably arranged in a helical pattern such that the current in the winding possesses both a circular component and an axial component, thereby forming a three-dimensional magnetic field. For example, the conductors of the winding can be arranged as disclosed in U.S. Pat. No. 4,021,602, the disclosure of which is hereby incorporated by reference. The axial component of the magnetic field induces an alternating heating current in the molten metal contained in the channel 2*a* of the furnace. The winding 10 is preferably constructed so as to obtain sufficient induction to produce a heating current that maintains the metal in the melting tank in a molten state.

The three-dimensional magnetic field also includes a radial component disposed perpendicular to the axial field component. The lines of flux of the radially oriented field flow between two diametrically opposite points that form North and South poles, respectively, on the surface of the coil, as illustrated in FIG. 2. The radially oriented field rotates about the core 6 of the inductor, due to the alternating current supplied to the winding 10, and thereby induces a flow of the molten metal in the channel 2*a*, as indicated by the arrow F.

In a preferred embodiment of the present invention, illustrated in FIGS. 3*a* and 3*b*, the magnetic core 6 for use in producing three-dimensional magnetic fields in a channel furnace includes an inner core 11 and an outer core 13 surrounding the inner core 11. The inner core 11 is comprised of a plurality of disk-shaped sheets 12 of magnetic which are stacked upon one another to form a substantially cylindrical core. The outer core 13 is comprised of a plurality of elongated sheets 14 of magnetic material each having a length coextensive with that of the cylinder comprising the inner core 11. These elongated sheets 14 are disposed in a generally radial pattern. Each sheet preferably has an involute shape, i.e., it is curved slightly in the circumferential direction, rather than lying directly on a radial plane throughout its width.

When current is supplied to the coil 6 around the magnetic core illustrated in FIGS. 3*a* and 3*b*, the inner core 11 will conduct the radial magnetic flux produced by the coil 6 but will not conduct the axial flux, to thereby avoid interference with the axial flux conducted by the outer core 13. In addition to conducting axial flux, the outer core 13 will deliver a small amount of radial flux to the inner core 11. However, the losses produced by this flux are slight and substantially improved over the prior art magnetic cores.

The present invention may be embodied in other specific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A channel furnace for metals, comprising:

a melting tank;

a duct forming a loop below said tank, said duct having an inner channel connected to two different zones in the bottom of said tank; and an inductor disposed within said loop for producing a three-dimensional magnetic field to heat and circulate metal in said channel, said inductor including:

a magnetic core having an inner core formed from a plurality of disk-shaped sheets stacked upon one another to form a substantially cylindrical core and an outer core surrounding said inner core formed from a plurality of elongated sheets extending in the longitudinal direction of the core, each elongated sheet being generally radially oriented, and a coil surrounding said magnetic core.

2. The channel furnace of claim 1 wherein each of said elongated sheets forming said outer core has an involute shape.

* * * * *